US012023551B1

(12) United States Patent
Jiang

(10) Patent No.: US 12,023,551 B1
(45) Date of Patent: Jul. 2, 2024

(54) SWIMMING ASSIST GARMENT CAPABLE OF ADJUSTING BUOYANCY POSITIONS

(71) Applicant: Splashbliss LLC, Sacramento, CA (US)

(72) Inventor: Mengqi Jiang, Anhui (CN)

(73) Assignee: Splashbliss LLC

( * ) Notice: Subject to any disclaimer, the term of this patent is extended or adjusted under 35 U.S.C. 154(b) by 0 days.

(21) Appl. No.: 18/589,487

(22) Filed: Feb. 28, 2024

(51) Int. Cl.

| | |
|---|---|
| ***A63B 31/00*** | (2006.01) |
| ***B60C 29/00*** | (2006.01) |
| ***B63C 9/00*** | (2006.01) |
| ***B63C 9/125*** | (2006.01) |

(52) U.S. Cl.
CPC ..... *A63B 31/00* (2013.01); *B63C 9/1255* (2013.01); *B63C 9/24* (2013.01); *B63C 2009/0029* (2013.01)

(58) Field of Classification Search
CPC ... A63B 31/00; B63C 9/00; B63C 2009/0023; B63C 2009/0029; B63C 9/08; B63C 9/081; B63C 9/087; B63C 9/105; B63C 9/1055; B63C 9/11; B63C 9/125; B63C 9/1255; A41D 7/00; A41D 7/001; A41D 7/003; A41D 13/012; A41D 13/0125
USPC ..... 441/80, 88, 90, 92, 102, 106, 108, 110, 441/111, 114, 115, 116, 117, 118, 29
See application file for complete search history.

(56) References Cited

U.S. PATENT DOCUMENTS

| | | | | |
|---|---|---|---|---|
| 6,350,168 | B1 * | 2/2002 | Kroll | B63C 9/125 441/111 |
| 2002/0157165 | A1 * | 10/2002 | Kroll | G02C 5/00 2/102 |
| 2007/0049141 | A1 * | 3/2007 | Staver | A41D 7/001 441/115 |
| 2011/0009020 | A1 * | 1/2011 | Withers | B63C 9/1255 441/118 |
| 2017/0006932 | A1 * | 1/2017 | Quaglia | B63C 9/087 |

FOREIGN PATENT DOCUMENTS

| | | | | |
|---|---|---|---|---|
| GB | 2542839 A | * | 4/2017 | A41D 13/0125 |

* cited by examiner

*Primary Examiner* — Daniel V Venne

(57) ABSTRACT

Embodiments provide a swimming assist garment capable of adjusting buoyancy positions. In the embodiments, the swimming assist garment includes a swimsuit, a buoyancy mechanism, and a gas regulating mechanism. The inflatable end of the gas regulating mechanism is connected to first airbags of a first buoyancy assembly and a second airbag of a second buoyancy assembly. The first bidirectional air pumps are connected to each first airbag and each third airbag of the first buoyancy assembly; and a second bidirectional air pump is connected to the second airbag and the fourth airbag of the second buoyancy assembly, to change the buoyancy positions of the swimsuit to adapt to swimming postures or to support the head on the water.

14 Claims, 14 Drawing Sheets

SWIMMING ASSIST GARMENT CAPABLE OF ADJUSTING BUOYANCY POSITIONS

TECHNICAL FIELD

The present disclosure belongs to a technical field of swimming apparatus, and in particular, relates to a swimming assist garment capable of adjusting buoyancy positions.

BACKGROUND

Swimming is a popular sport loved by many, providing both physical fitness and leisure entertainment. However, for many beginners, mastering swimming skills can be challenging, for this reason swim assists have appeared on the market, with built-in airbags or foam blocks to provide buoyancy to prevent the beginners from sinking in order to assist them in swimming training.

However, when the traditional swimsuit is used in the water, it cannot adjust the buoyancy positions to adapt to the beginner's movement habits and body tilt state, resulting in the beginner's body is difficult to maintain balance, the experience effect is poor. In addition, when the beginners appear to be physically unwell, fatigue and other conditions, it is not able to carry out the emergency lifesaving, such that the safety coefficient is relatively low.

SUMMARY

Technical Problems to be Solved

The present disclosure provides a swimming assist garment capable of adjusting buoyancy positions, swimming postures can be fitted after the buoyancy positions are adjusted, improving the use experience; and it also provides a life-saving ability in an emergency situation, improving the safety coefficient.

Technical Solution

In order to realize the above objects, the present disclosure provides the following technical solutions:

A swimming assist garment capable of adjusting buoyancy positions, comprising a swimsuit, buoyancy foams filled in the swimsuit, a buoyancy mechanism and a gas regulating mechanism; the buoyancy mechanism comprising a first buoyancy assembly and a second buoyancy assembly; the first buoyancy assembly comprises first airbags and third airbags mounted on a front side of the swimsuit, the second buoyancy assembly comprises a second airbag and a fourth airbag mounted on a back side of the swimsuit, and each third airbag and the fourth airbag are designed to match with a human neck when fully expanded; the gas regulating mechanism is mounted on the swimsuit and comprises a connector, an inflatable end, first bidirectional air pumps and a second bidirectional air pump; the inflatable end is connected to each first airbag and the second airbag via the connector, the first bidirectional air pumps are connected to each first airbag and each third airbag, and the second bidirectional air pump is connected to the second airbag and the fourth airbag.

Preferably, the swimsuit is provided with a first sandwich and a first opening slot on the front side, and the swimsuit is provided with a second sandwich and a second opening slot on the back side; each first airbag and the second airbag are provided in the first sandwich and the second sandwich, respectively; each third airbag are mounted in the first opening slot and each third airbag is capable of expanding out of the first opening slot; the fourth airbag is provided in the second opening slot and the fourth airbag is capable of expanding out of the second opening slot.

Preferably, each third airbag is fixedly connected to a bottom wall of the first opening slot in a middle of each third airbag, each third airbag is provided with magnetic blocks at both ends of each third airbag, the bottom wall of the first opening slot is provided with a magnetic suction block that is mutually adsorbed with the magnetic blocks; and the magnetic blocks are detached from the magnetic suction block when each third airbag is fully expanded.

Preferably, the second buoyancy assembly further comprises a fifth airbag mounted on a top of the back side of the swimsuit, the gas regulating mechanism further comprises a solenoid valve mounted on the swimsuit and connected to the fourth airbag and the fifth airbag, the fifth airbag is matched with a human head when expanded.

Preferably, the fifth airbag is mounted with a hanging strap.

Preferably, a main control mechanism is further included; wherein the main control mechanism comprises a control panel and a plurality of control buttons mounted on the swimsuit; the control panel is mounted inside the swimsuit and electrically connected to the first bidirectional air pumps, the second bidirectional air pump and the plurality of control buttons.

Preferably, the main control mechanism further comprises a heart rate sensor, the control panel is provided with a heart rate module; the heart rate sensor is mounted on the swimsuit and is connected to the heart rate module by signaling, and the heart rate sensor is configured for detecting a human heart rate.

Preferably, the gas regulating mechanism further comprises a gas cylinder, a mouth of the gas cylinder is mounted with a sensing switch electrically connected to the control panel; the connector is a two-in-one-out gas valve, and two inlets of the valve is connected to the inflatable end and the gas cylinder respectively, and outlet of the gas valve is connected to the first airbags and the second airbag.

Preferably, the main control mechanism further comprises an air pressure sensor mounted on the swimsuit and electrically connected to the control panel, and the air pressure sensor is connected to each third airbags and the fourth airbag.

Preferably, a waterproof shell is further included and mounted on the swimsuit, and the gas regulating mechanism and the main control mechanism are both provided inside the waterproof shell.

Preferably, the front side of the swimsuit is divided into two pieces of suit body capable to be fixed or detached from each other, the first airbags are provided with two and each is provided on each piece of the suit body, and the third airbags are provided with two and each is provided on a top of each piece of the suit body in order to match with a position of the human neck; and the first bidirectional air pumps are provided with two, corresponding to the first airbags.

Preferably, the swimsuit is further provided with a zipper and buckle straps, and the zipper and the buckle straps are connected to the two pieces of the suit body; by pulling the zipper, the two pieces of the suit body are fixed or disengaged from each other; and by adjusting lengths of the buckle straps, looseness or tightness of the two pieces of the suit body is adjusted.

Preferably, the buckle straps are provided with two and provided up and down.

Preferably, the swimsuit is further provided with a crotch strap provided at a bottom of the swimsuit and connected the front side of the swimsuit and the back side of the swimsuit to match with a human crotch.

Beneficial Effects

The present disclosure provides a swimming assist garment capable of adjusting buoyancy positions. The present disclosure makes the swimsuit have a certain buoyancy by filling the buoyancy foams inside the swimsuit to ensure that the swimsuit itself has a certain life-saving ability. By providing the inflatable end and the connector for providing gas to the first airbags, the second airbag, the third airbags, and the fourth airbag in the swimsuit, such that the swimsuit can have a better buoyancy, so as to further enhance the safety of the swimsuit. With this design, the amount of buoyancy foams filled inside the swimsuit can be appropriately reduced. By designing the first bidirectional air pumps for controlling the gas exchange between the first airbags and the third airbags, and by designing the second bidirectional air pump for controlling the gas exchange between the second airbag and the fourth airbag, the buoyancy positions of the swimsuit can be changed and the ratio of buoyancy at the buoyancy positions can be adjusted, so as to adapt to the swimming postures and to support the head. It not only improves the use experience, but also has the ability to save lives in case of emergency and improves the safety coefficient.

BRIEF DESCRIPTION OF DRAWINGS

The figures are used to provide a further understanding of the present disclosure and form part of the specification. The figures are used in combination with embodiments of the present disclosure to explain the present disclosure and do not constitute a limitation of the present disclosure, in the figures.

In the figures.

Figure 1:
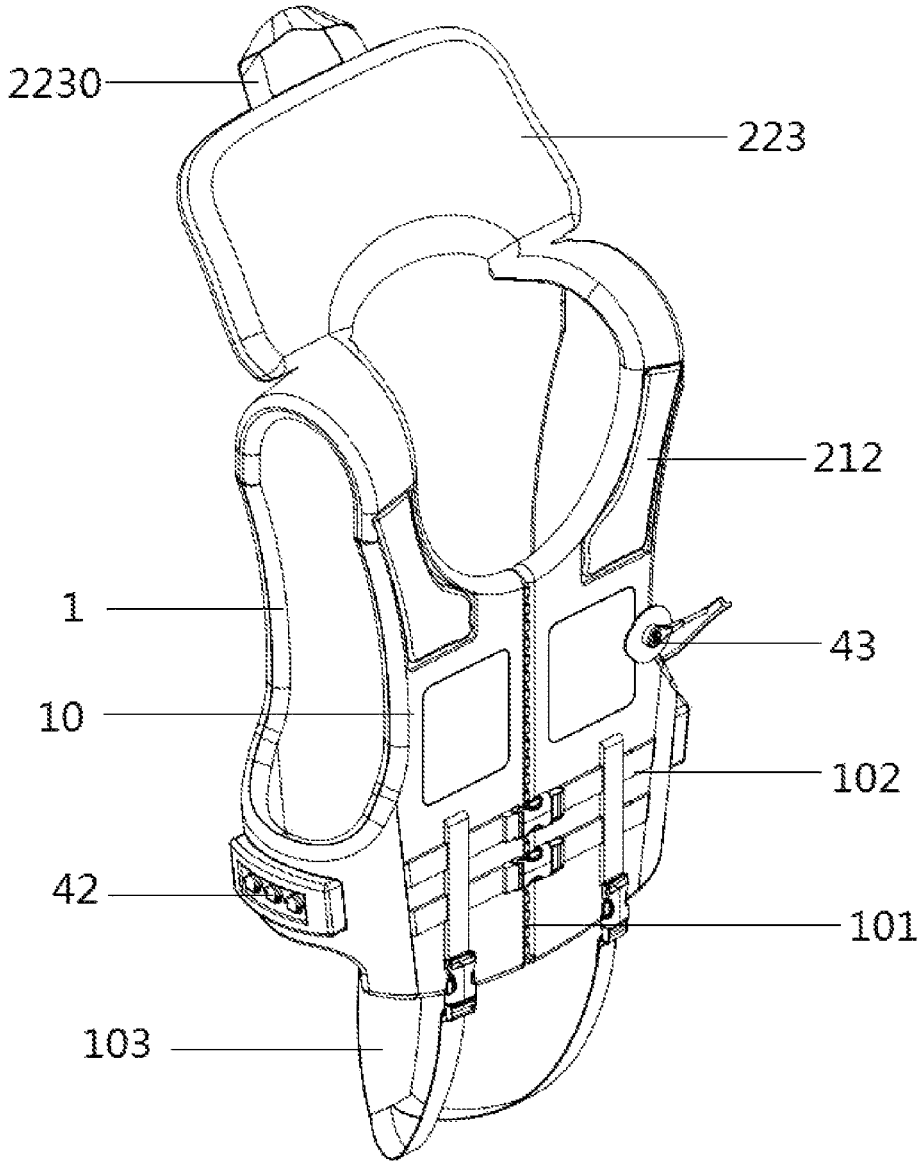
FIG. 1 illustrates a first schematic diagram of an overall structure according to the present disclosure.

1—swimsuit, 10—suit body, 101—zipper, 102—buckle strap, 103—crotch strap, 11—first sandwich, 12—first opening slot, 120—magnetic suction block, 13—second sandwich, 14—second opening slot;

2—buoyancy mechanism, 21—first buoyancy assembly, 211—first airbag, 212—third airbag, 2120—magnetic block, 22—second buoyancy assembly, 221—second airbag, 222—fourth airbag, 223—fifth airbag, 2230—hanging strip;

3—gas regulating mechanism, 31—connector, 32—inflatable end, 33—first bidirectional air pump, 34—second bidirectional air pump, 35—solenoid valve, 36—gas cylinder, 360—sensing switch;

4—main controlling mechanism, 41—control panel, 411—heart rate module, 412—wireless receiving module, 42—control button, 43—heart rate sensor, 44—air pressure sensor, 45—battery, 5—waterproof shell

DESCRIPTION OF EMBODIMENTS

The technical solutions in the embodiments of the present disclosure will be described clearly and completely in the following in conjunction with the accompanying drawings in the embodiments of the present disclosure. It is obvious that the described embodiments are only a part of the embodiments of the present disclosure and not all of the embodiments. Based on the embodiments of the present disclosure, all other embodiments obtained by a person of ordinary skill in the art without making inventive efforts are within the protect scope of the present disclosure.

Referring to FIGS. 1-10, a swimming assist garment capable of adjusting buoyancy positions includes a swimsuit 1, buoyancy foams filled in the swimsuit 1, a buoyancy mechanism 2, and a gas regulating mechanism 3. The buoyancy mechanism 2 comprises a first buoyancy assembly 21 and a second buoyancy assembly 22. The first buoyancy assembly 21 comprises first airbags 211 and third airbags 212 mounted on the front side of the swimsuit 1, and the second buoyancy assembly 22 comprises a second airbag 221 and the fourth airbag 222 mounted on the back side of the swimsuit 1. The third airbag 212 and the fourth airbag 222 are designed to match with the human neck after fully expanded. The gas regulating mechanism 3 is mounted on the swimsuit 1 and includes a connector 31, an inflatable end 32, first bidirectional air pumps 33, and a second bidirectional air pump 34. The inflatable end 32 is connected to the first airbag 211 and the second airbag 221, the first bidirectional air pump 33 is connected to the first airbag 211 and the third airbag 212, and the second bidirectional air pump 34 is connected to the second airbag 221 and the fourth airbag 222.

Specifically, before use, the inflatable end 32 is first connected using an inflatable device, and gas is injected into the first airbags 211 and the second airbag 221 through the connector 31, and after the first airbag 211 and the second airbag 221 are expanded, the first bidirectional air pumps 33 and the second bidirectional air pump 34 can be started at the same time, so as to pump the gas inside the first airbags 211 to the third airbags 212, and pump the gas inside the second airbag 221 to the fourth airbag 222, such that the third airbags 212 and the fourth airbag 222 are expanded to a suitable state, and the swimsuit 1 can be worn on the water.

Figure 12:
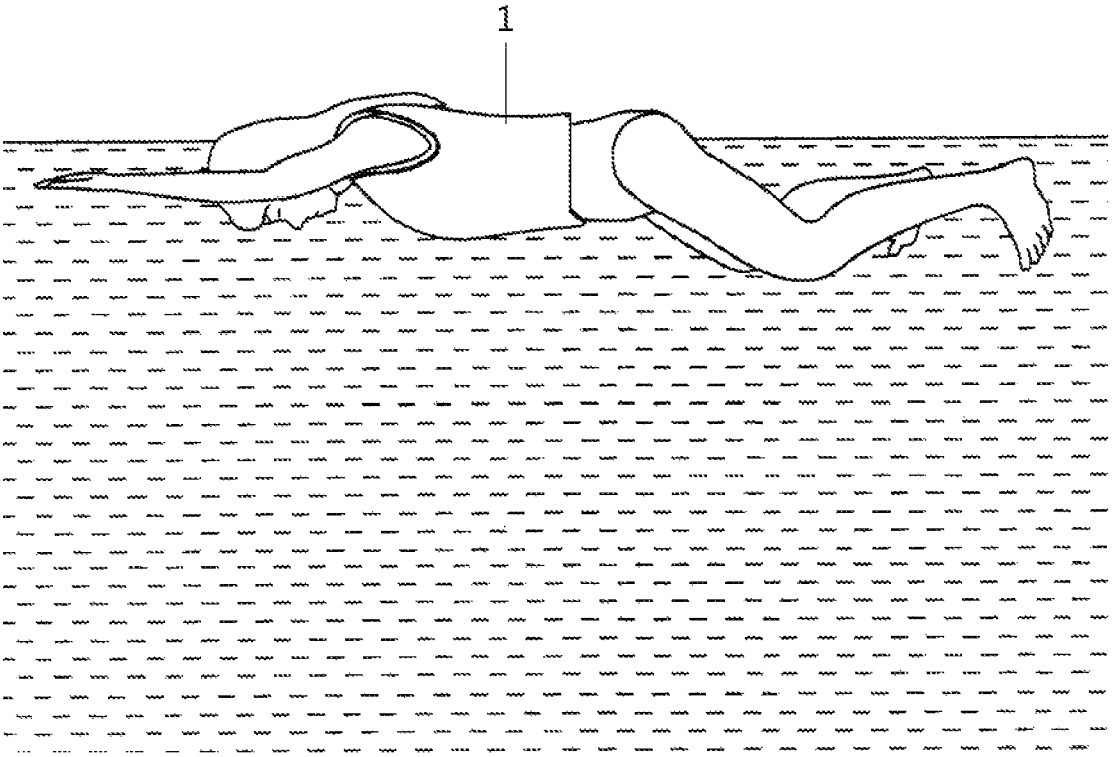
FIG. 12 illustrates a first schematic diagram of a use action according to the present disclosure I.
Figure 13:
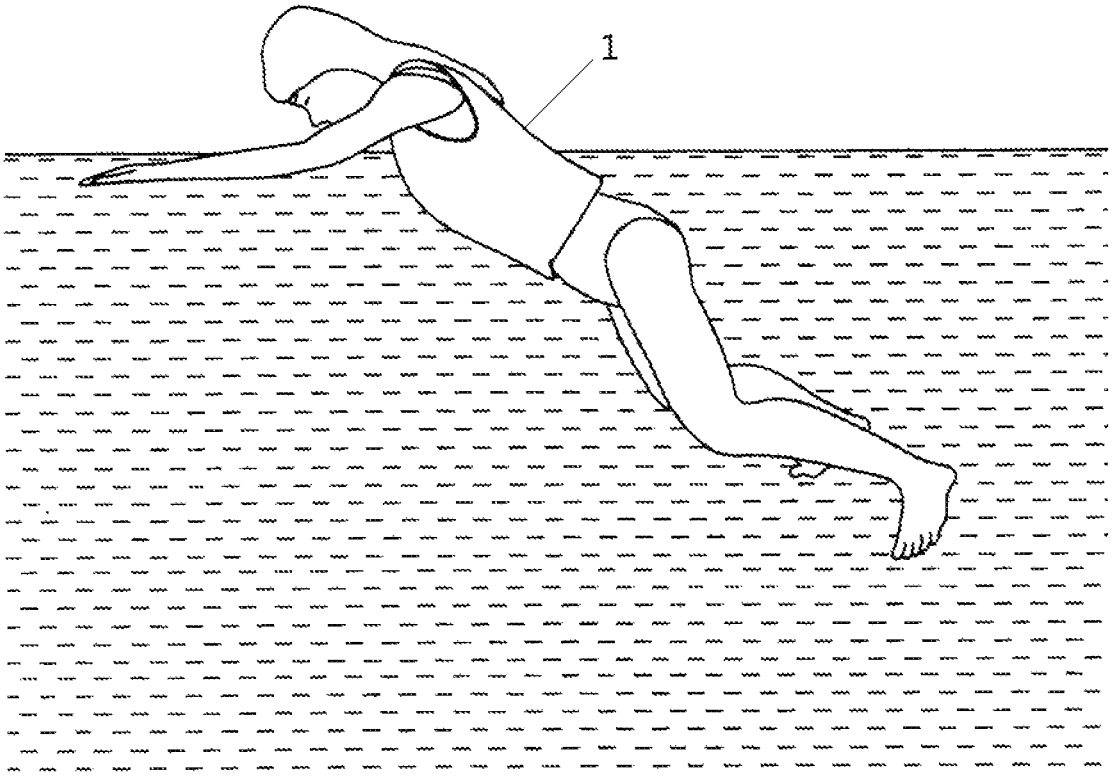
FIG. 13 illustrates a second schematic diagram of the use action according to the present disclosure.
Figure 14:
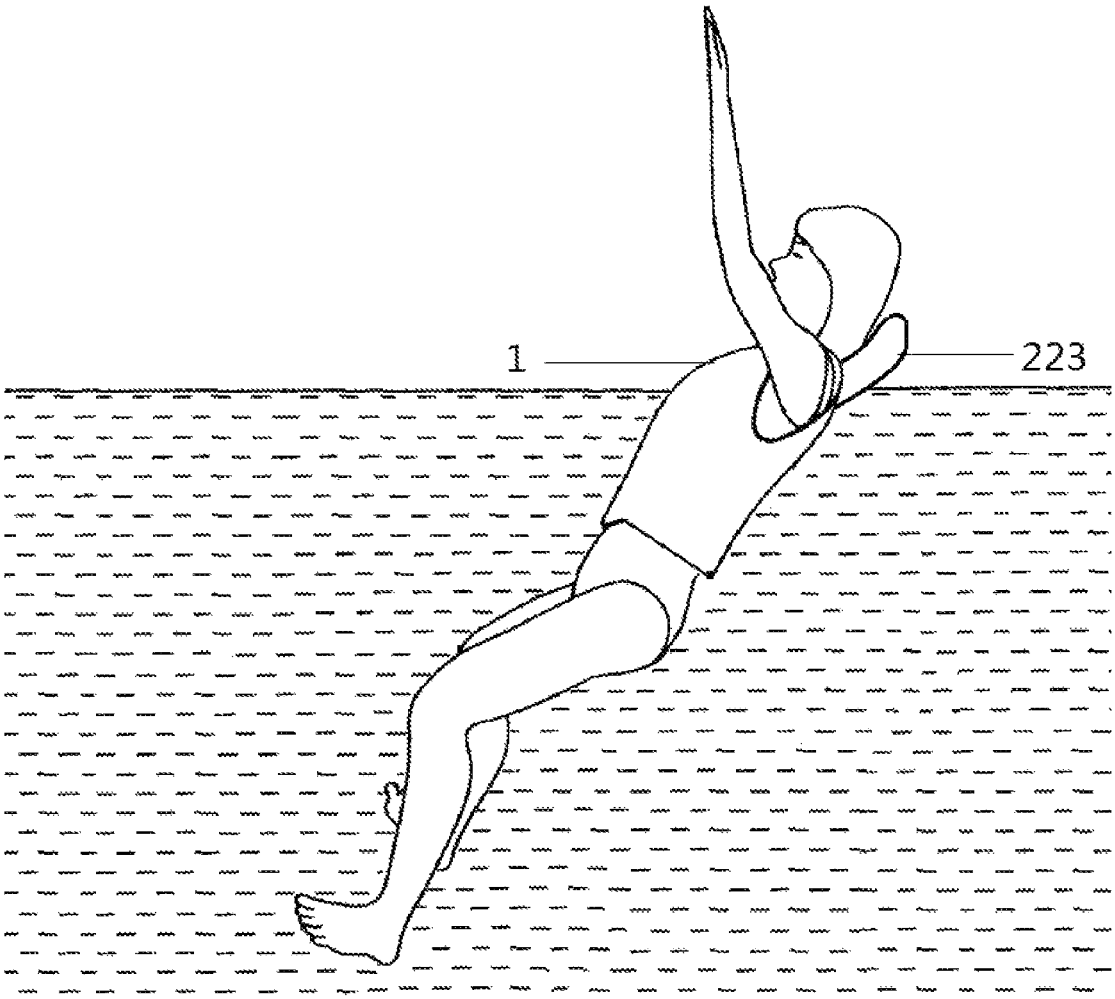
FIG. 14 illustrates a third schematic diagram of the use action according to the present disclosure.

As shown in FIG. 12 and FIG. 13, when used in water, the first airbags 211, the second airbag 221, the third airbags 212 and the fourth airbag 222 can simultaneously provide buoyancy for the swimsuit 1 to prevent the user from sinking; and the user can also activate the first bidirectional air pumps 33 or the second bidirectional air pump 34 to control the gases inside the first airbag 211 and the third airbag 212 to exchange with one another, as well as the control of the gases inside the second airbag 221 and the fourth airbag 222 to exchange with each other, thereby changing the buoyancy positions of the swimsuit 1 and the ratio of the buoyancy at the corresponding buoyancy positions, so as to adapt to the user's swimming postures, and to facilitate the user's training of swimming skills.

As shown in FIG. 13, when the user experiences an emergency such as physical discomfort or breathing difficulty, the first bidirectional air pumps 33 and the second bidirectional air pump 34 can be activated, and all the gases in the first airbag 211 and the second airbag 221 are pumped to the third airbag 212 and the fourth airbag 222, such that the third airbag 212 and the fourth airbag 222 are fully expanded and have a great buoyancy force. Since the third airbag 212 and the fourth airbag 222 match with the front and back sides of the human neck respectively, such that the supported head of the user can be effectively exposed on the water to avoid drowning.

After use, the user is required to control the first bidirectional air pump 33 and the second bidirectional air pump 34 to pump the gases in the third airbag 212 and the fourth airbag 222 to the first airbag 211 and the second airbag 221, respectively, and at the same time to open the inflatable end 32 to discharge the gases in the first airbag 211 and the second airbag 221 to the ambient.

In the other aspect, by filling the swimsuit 1 with buoyancy foams, the swimsuit 1 is prepared to have a certain buoyancy. In case of an emergency such as the loss of the buoyancy mechanism 2, the design ensures that the swimsuit 1 still has the ability to save lives, improves the safety coefficient, and protects the safety of the user. The material of the buoyancy foam is polyethylene foam, which makes the buoyancy foam have the advantages of small density, cushioning, heat resistance, small water absorption, stable chemical properties, not easy to be corroded, good mechanical properties, tough, flexible, friction resistance, good processing performance, easy to form, cheaper and so on, which is conducive to reducing the production cost of the swimming assist garment, and facilitates the processing and production.

In summary, the present disclosure makes the swimsuit 1 have a certain buoyancy by filling the buoyancy foams inside the swimsuit 1 to ensure that the swimsuit 1 has a certain life-saving ability by itself. By providing the inflatable end 32 and the connector 31 on the swimsuit 1 for providing gas to the first airbag 211, the second airbag 221, the third airbag 212, and the fourth airbag 222, the swimsuit 1 can have a better buoyancy, thus further improving the safety of the swimsuit 1. Under this design, the amount of buoyancy foams filling inside the swimsuit 1 can be reduced in an appropriate amount. By designing the first bidirectional air pumps 33 for controlling the gas exchange between the first airbags 211 and the third airbags 212, and by designing the second bidirectional air pump 34 for controlling the gas exchange between the second airbag 221 and the fourth airbag 222, thereby changing the buoyancy positions of the swimsuit 1 and adjusting the ratio of the buoyancy at the buoyancy positions, so as to adapt the swimming postures and support the head, which not only improves the use experience, but also has the ability to save lives in an emergency, and improves the safety coefficient.

It should be noted that the individual airbags referred to in the present disclosure are existing products and that, in the conventional case, the capacity of the third airbag 212 and the fourth airbag 222 needs to be larger than that of the first airbag 211 and the second airbag 221, in order to avoid rupture of the third airbag 212 and the fourth airbag 222 after receiving the gases from the first airbag 211 and the second airbag 221;

In addition, regarding the first bidirectional air pumps 33 and the second bidirectional air pump 34, each is a kind of air pump that can inflate and exhaust by freely switching the inlet and the outlet, which also belongs to the existing products and is described in the patent No. CN219529300U as well as in the various search sites. While the connector 31 may be the conventional one-inlet-multiple-outlet type air valve, or other devices that can realize ventilation, and no limitation is made in the present disclosure.

Referring to FIGS. 1-5, the front side of the swimsuit 1 is provided with a first sandwich 11 and a first opening slot 12, and the back side of the swimsuit 1 is provided with a second sandwich 13 and a second opening slot 14. The first airbag 211 and the second airbag 221 are provided within the first sandwich 11 and the second sandwich 13, respectively, so as to avoid detachment from the swimsuit 1. The third airbag 212 is provided within the first opening slot 12, and the third airbag 212 is expandable to the ambient of the first opening slot 12. The fourth airbag 222 is mounted in the second opening slot 14, and the fourth airbag 222 is expandable to the ambient of the second opening slot 14.

Specifically, as shown in FIG. 1, before the third airbag 212 and the fourth airbag 222 are fully expanded, they are arranged in the first opening slot 12 and the second opening slot 14, respectively, in order to prevent them from protruding out of the swimsuit 1 in contact with the water and causing resistance, so as to facilitate the user to be able to use them normally.

Figure 2:
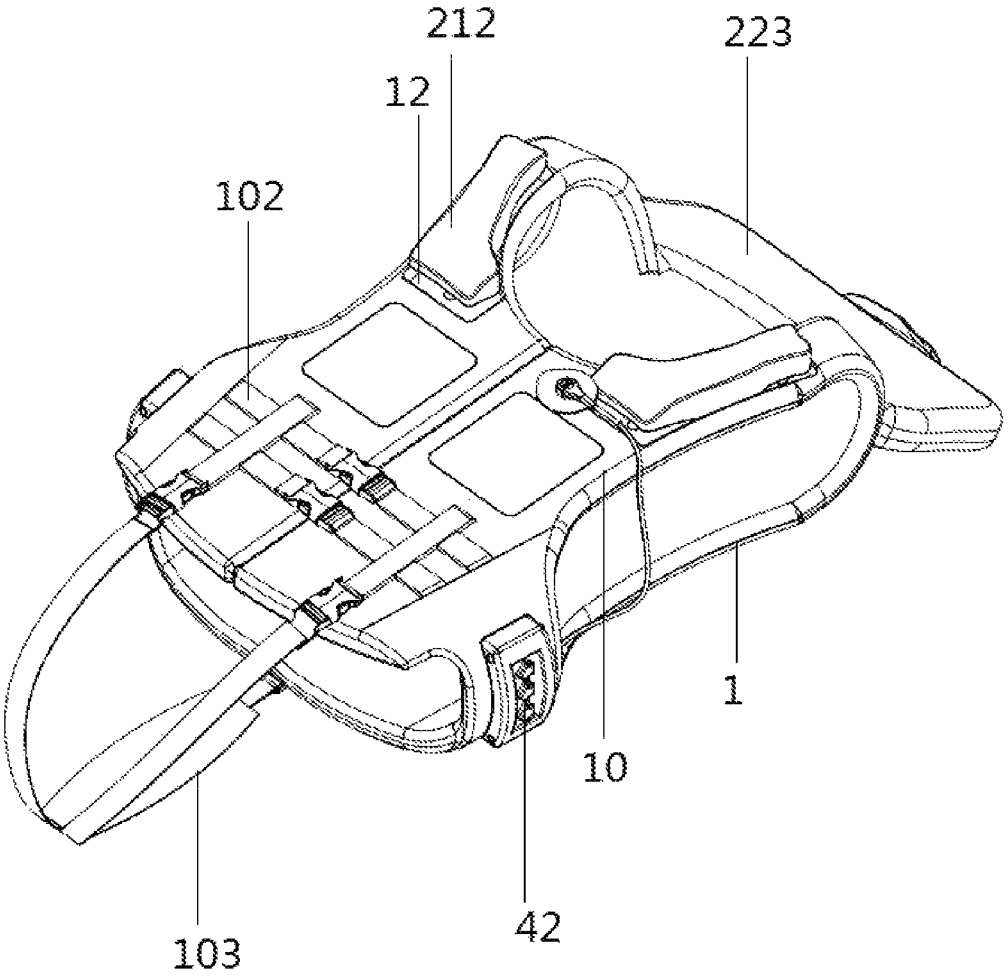
FIG. 2 illustrates a second schematic diagram of the overall structure according to the present disclosure.
Figure 3:
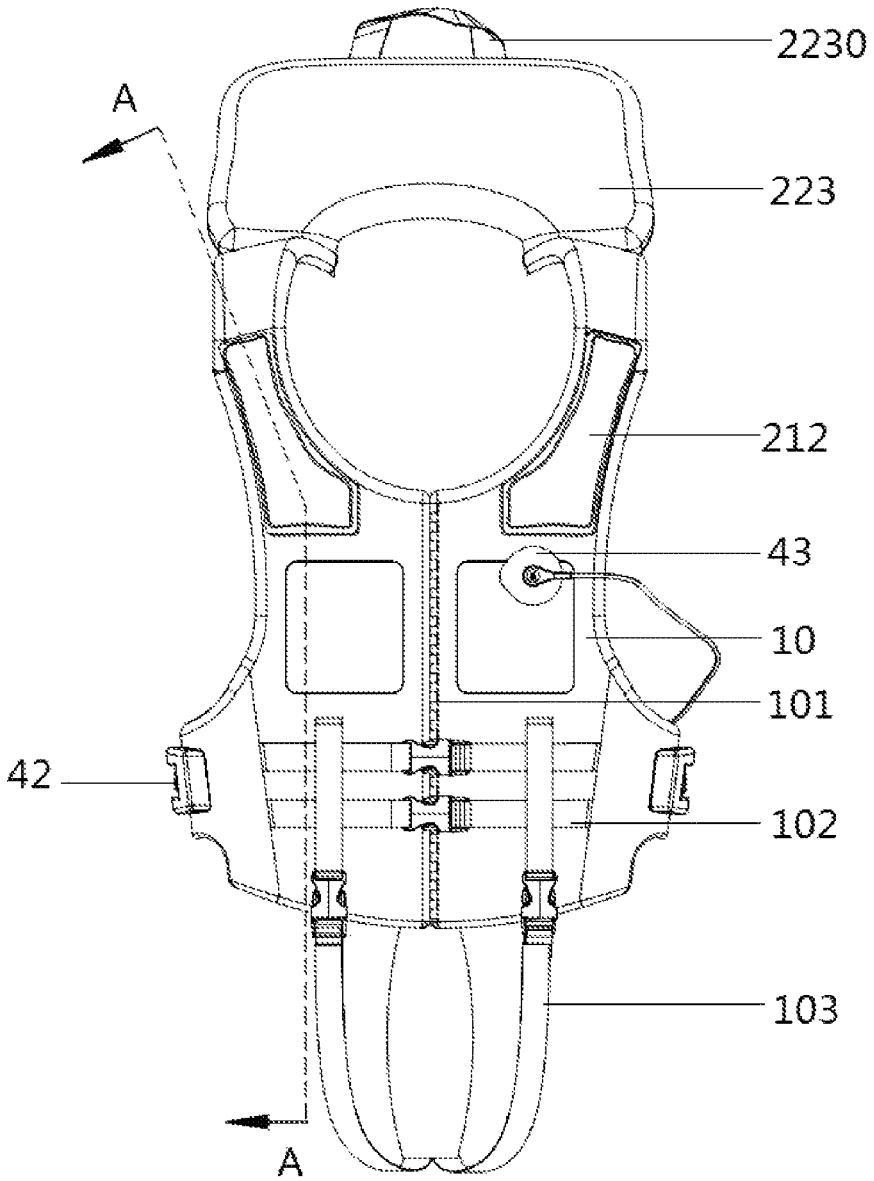
FIG. 3 illustrates a main view of FIG. 2 of the present disclosure.
Figure 4:
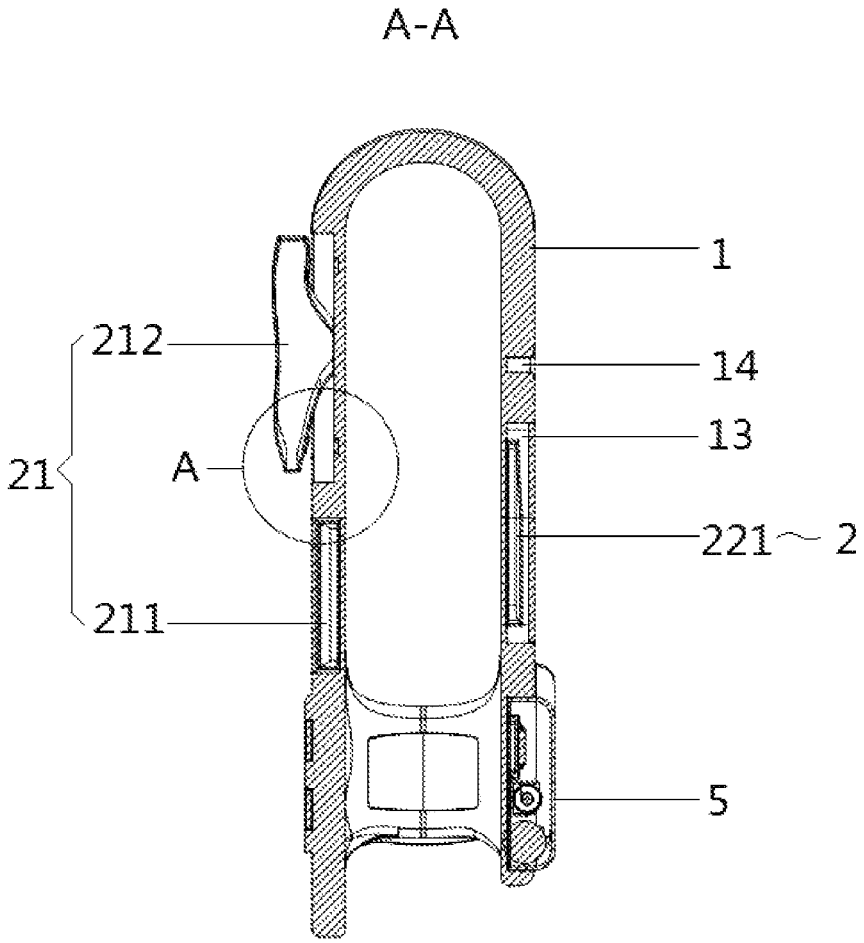
FIG. 4 illustrates an A-A sectional view of FIG. 3.
Figure 5:
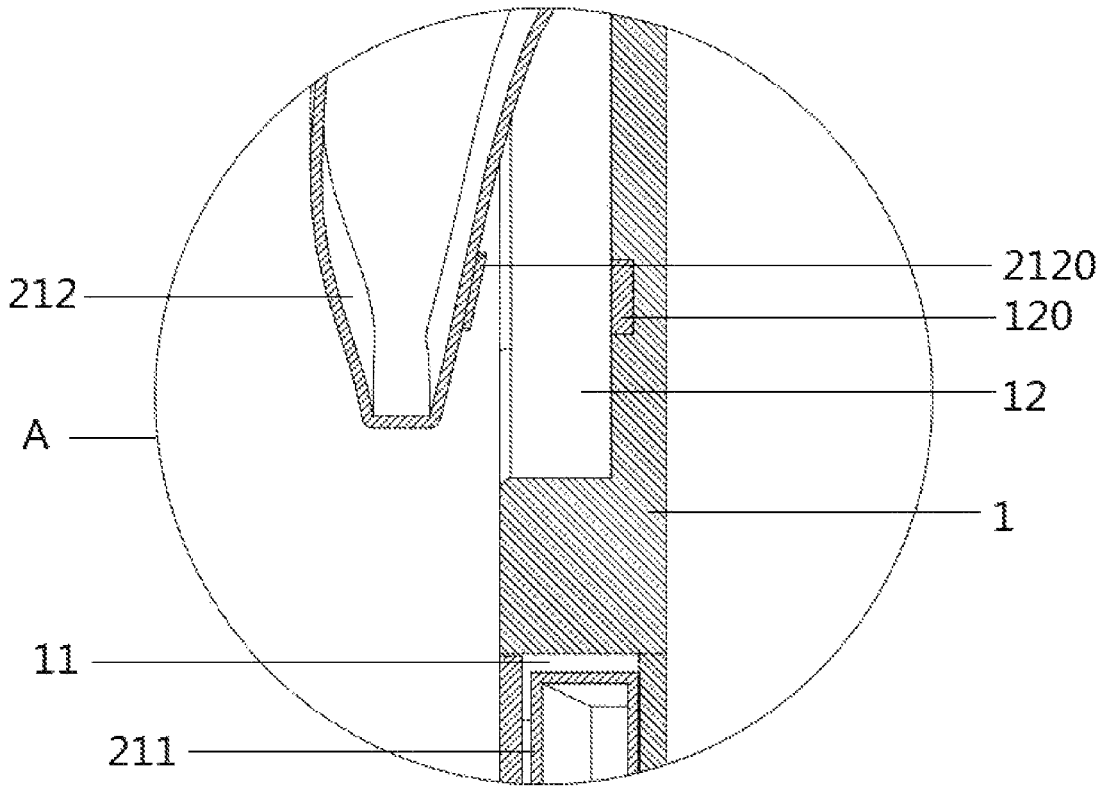
FIG. 5 illustrates an enlarged view at A in FIG. 4.

As shown in FIGS. 2-4, in case of emergency, the third airbag 212 and the fourth airbag 222 will be fully expanded, such that part of the third airbag 212 and part of the fourth airbag 222 will protrude out of the first opening slot 12 and the second opening slot 14 to the front and back of the user's chest, respectively, in order to increase the area of contact with the water, which in turn can support the head more effectively and ensure the safety of use.

In the other aspect, in view of the structure, the designs of the first opening slot 12 and the second opening slot 14 may also provide a larger movement space for the third airbag 212 and the fourth airbag 222, respectively, under which the manufacturer can provide a large volume of the third airbag 212 and the fourth airbag 222, such that the third airbag 212 and the fourth airbag 222 may hold more gas to increase the buoyancy of the swimsuit 1.

Figure 11:
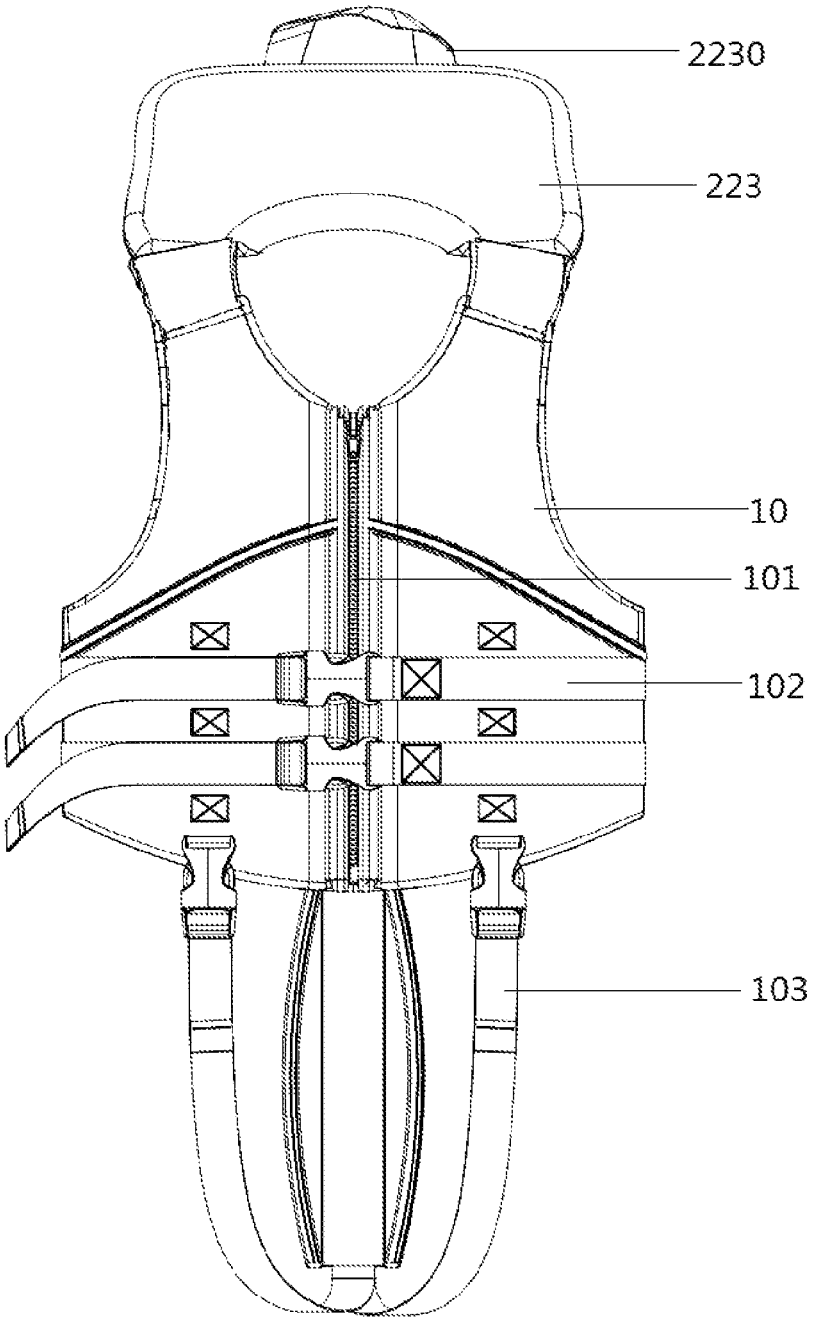
FIG. 11 illustrates a fifth schematic diagram of the overall structure according to the present disclosure.

It should be noted that no limitation is made on the actual shape of the swimsuit 1 in the present disclosure. For example, the swimsuit may be designed in the shape shown in the FIG. 11. Furthermore, in actual production, the first opening slot 13 and the second opening slot 14 may be blocked, such that the third airbag 212 and the fourth airbag 222 are embedded in the back and the front of the swimsuit 1, respectively, so as to enhance the overall aesthetics.

Referring to FIGS. 2-5, taking into account that in an emergency situation, the user's body is more likely to be tilted forward and lead to water ingress into the mouth and nose, in order to solve this problem, in the present disclosure, the middle of the third airbag 212 is fixedly connected to the bottom wall of the first opening slot 12, and the third airbag 212 is provided with magnetic blocks 2120 at both ends, and the bottom wall of the first opening slot 12 is provided with a magnetic suction block 120 that is adsorbed with the magnetic blocks 2120 each other. When the third airbag 212 is fully expanded, the magnetic blocks 2120 are detached from the magnetic suction block 120.

Specifically, under normal circumstances, the magnetic block 2120 adsorbs the magnetic suction block 120 such that the third airbag 212 is fully placed within the first opening slot 12.

In case of emergency, the third airbag 212 will inflate and expand, such that the squeezing pressure between the third airbag 212 and the first opening slot 12 continues to become larger until the magnetic block 2120 is detached from the magnetic suction block 120, and two ends of the third airbag 212 will be completely placed in the outside and make the whole of the third airbag 212 in a curved shape. At this time, the area of contact between the third airbag 212 and the water reaches the maximum, which can effectively resist the chest and neck to drive the user's body backward, reducing the possibility of the user's body tilting forward. When the user's body is tilted forward, due to a larger area of the third airbag 212 protrudes from the swimsuit 1, the buoyancy generated is sufficient to support the user's head on the water, so as to effectively prevent the water getting into the user's nose and mouth.

In the other aspect, the design of using the magnetic block 2120 to adsorb the magnetic suction block 120 to restrict the third airbag 212 facilitates the user to re-secure the dried-out third airbags 212 in the first opening slot 12 after use, which improves the operation convenience.

Referring to FIGS. 1-FIG. 6 and FIG. 14, the second buoyancy assembly 22 further comprises a fifth gas airbag 223 mounted on the top of the back side of the swimsuit 1. The gas regulating mechanism 3 further comprises a solenoid valve 35, the solenoid valve 35 is mounted to the swimsuit 1 and connected to the fourth gas airbag 222 and the fifth gas airbag 223, the fifth gas airbag 223 is matched with the human head after expanded. Wherein the solenoid valve 35 belongs to an existing product, which can close or open the gas channel, thereby cutting off or turning on the fourth airbag 222 and the fifth airbag 223.

Specifically, under normal circumstances, the fifth airbag 223 is in a dried-out state (this state is not shown in the figures) and may be attached and fixed to the top of the swimsuit 1 by means of a snap-fit, bonding, magnetic connection, or the like, in order to facilitate the normal use of the swimsuit 1.

Under special circumstances, such as when the user needs to perform backward leaning training or needs to save himself, the solenoid valve 35 can be controlled to open the gas channel, such that the gas in the fourth airbag 222 can flow into the fifth airbag 223 via the solenoid valve 35, which then drives the fifth airbag 223 to expand to support the back side of the user's head, so as to reduce the pressure borne by the neck, and to improve the use comfort and safety.

Wherein, when the fifth airbag 223 has sufficient gas, the user can control the solenoid valve 35 to close the gas channel to prevent the gas within the fifth airbag 223 and the fourth airbag 222 from moving back and forth and affecting normal use. After use, the solenoid valve 35 needs to be re-controlled to open the gas channel, so as to facilitate the user's ability to squeeze the gas within the fifth airbag 223 into the fourth airbag 222, and the gas within the fourth airbag 222 can flow into the second airbag 221 and be discharged to the ambient through the connector 31 and the inflatable end 32.

It should be noted that regarding the connections among the first airbags 211, the second airbag 221, the third airbags 212, the fourth airbag 222 and the fifth airbag 223 with the connector 31, the first bidirectional air pumps 33, the second bidirectional air pump 34, and the solenoid valve 35, the connections can be made by directly providing the corresponding air circuit (not shown in the figures) or laying the corresponding hose (not shown in the figures) within the swimsuit 1. Because the related structures are varied, no limitation is made in the present disclosure. While with respect to the shapes of the first airbag 211, the second airbag 221, the third airbag 212, the fourth airbag 222 and the fifth airbag 223, the manufacturer may design them according to the actual situation, and no limitation is made in the present disclosure in this regard.

Referring to FIGS. 1-3, the fifth airbag 223 is further mounted with a hanging strap 2230, making it convenient to hang the assist garment on a hanger when not in use, thus improving usability.

Referring to FIGS. 7-10, for convenience, the present disclosure also includes a main control mechanism 4. The main control mechanism 4 includes a control panel 41 and a plurality of control buttons 42 mounted on the swimsuit 1. The control panel 41 is mounted inside the swimsuit 1 and is electrically connected to the first bidirectional air pumps 33, the second bidirectional air pump 34 and the control buttons 42.

Specifically, the design of the control buttons 42 and the control panel 41 can facilitate the user to manipulate the operation status of the components such as the first bidirectional air pumps 33, the second bidirectional air pump 34 and the like on his/her own, and thus to manually adjust the ratio of gases in the first airbag 211, the second airbag 221, the third airbag 212 and the fourth airbag 222.

Among them, the technique of controlling the operation of the electrical components by controlling the buttons 42 belongs to common sense, so the specific circuit structure thereof is not elaborated in the present disclosure.

It should be noted that that the swimsuit 1 is designed with a fifth airbag 223, then the control panel 41 may also be electrically connected to the solenoid valve 35 in order to control the ON-OFF of the solenoid valve 35 by means of the control button 42.

Referring to FIG. 1, and FIG. 7-FIG. 10, taking into account that the user may encounter a sudden illness or a transient shock due to a high heart rate during the swimming process, in which case the user is difficult to control the gas regulating mechanism 3 on his own to adjust the buoyancy mechanism 2. For this reason, in the present disclosure, the main control mechanism 4 also includes a heart rate sensor 43, the control panel 41 is provided with a heart rate module 411, the heart rate sensor 43 is mounted on the suit body and is signaling connected to the heart rate module 411, and the heart rate sensor 43 is used to detect the human heart rate.

Specifically, when the heart rate sensor 43 detects that the user's heart rate is abnormal, it will send an emergency signal to the heart rate module 411, and then the control panel 41 will drive the first bidirectional air pumps 33 and the second bidirectional air pump 34 to activate, and pump the gases inside the first airbag 211 and the second airbag 221 to the third airbag 212 and the fourth airbag 222, such that the third airbag 212 and the fourth airbag 222 will rapidly expand to support the user's neck to expose the user's head on the water.

Therefore, the coordinated design of the heart rate sensor 43 and the heart rate module 411 can automatically control the gas regulating mechanism 3 to adjust the buoyancy mechanism 2 when the user is in a critical state, such that the safety coefficient can be improved.

It should be noted that the heart rate sensor 43 can be connected to the heart rate module 411 signaling by wired or wireless means, and accordingly, the heart rate sensor 43, in turn, can be used at the skin of the human chest by suction cups affixed thereto, or built into a device such as a watch, bracelet, etc., which is not limited in the present disclosure.

Referring to FIGS. 7-10, taking into account that in actual use, a leakage of gas from each airbag is occurred, leading to insufficient gas, and users in the water encounter danger as a result, in order to solve this problem, in the present disclosure, the gas regulating mechanism 3 also includes a gas cylinder 36, and a sensing switch 360 electrically connected to the control panel 41 is mounted at the mouth of the gas cylinder 36. The connector 31 is a two-inlet-one-outlet type of gas valve, the two inlets of the valve are connected to the inflatable end 32 and the gas cylinder 36 respectively, and the outlet of the valve is connected to the first airbag 211 and the second airbag 221.

Specifically, in the conventional case, if the first airbag 211 and the second airbag 221 have a slight air leakage that prevents normal use, the user may activate the sensing switch 360 via the control panel 41 to inject into the first airbag 211 and the second airbag 221 to maintain normal use of the first airbag 211, the second airbag 221, the third airbag 212 and the fourth airbag 222. If the first airbag 211 and the second airbag 221 leak faster, for safety reasons, the user should give up continuing to use the first airbag 211 and the second airbag 221, and pump the gases in the first airbag 211 and the second airbag 221 to the third airbag 212 and the fourth airbag 222 through the first bidirectional air pump 33 and the second bidirectional air pump 34 in a timely manner, so as to avoid danger.

In case of emergency, if the user finds that the third airbag 212 or the fourth airbag 222 leaks in an emergency, the user can activate the sensing switch 360 through the control panel 41 to continuously inject gas into the first airbag 211 and the second airbag 221, and at the same time continuously pump the gases in the first airbag 211 and the second airbag 221 through the first bidirectional pump 33 and the second bidirectional pump 34 to the third airbag 212 and the fourth airbag 222, so as to maintain the normal use of the third airbag 212 and the fourth airbag 222. If the third airbag 212 and the fourth airbag 222 leaks gas faster, then the first bidirectional air pumps 33 and the second air pump are turned off, so as to make sure that the first airbag 211 and the second airbag 221 remain inflated by giving up the use of the third airbag 212 and the fourth airbag 222, such that the swimsuit 1 can continue to provide buoyancy to prevent the user from sinking, thereby increasing the probability of rescue.

Among other things, as an emergency air supply source, gas cylinder 36 is usually used only when the user is in a critical situation, such as abnormal heart rate or physical discomfort, to ensure safety. While the user can use it in a regular state, it is not recommended to try it.

It should be noted that, for the convenience of understanding, the embodiment according to the present disclosure explains the parts of the inflatable end 32, the gas cylinder 36 and the two-inlet-one-outlet valve. Among them, the inflatable end 32 is a component with the function of inflating and deflating, which is widely used in basketballs and tires, etc. The two-inlet-one-outlet valve refers to the valve with two inlets and one outlet. The gas cylinder 36 refers to the gas supply part filled with compressed carbon dioxide gas, the sensing switch 360 mounted at the mouth of the gas cylinder 360 will open the mouth to release carbon dioxide gas to supply gas to the valve after energization, and close the mouth after power failure. Since the above components belong to the prior art, and the technology of controlling the state of use of the gas cylinder 36 by means of the control panel 41 is relatively common in the technical field, therefore, the present disclosure does not make further elaboration on the corresponding structural principles and circuit structure.

Referring to FIGS. 7-10, the main control mechanism 4 further comprises an air pressure sensor 44, the air pressure sensor 44 is mounted on the swimsuit 1 and electrically connected to the control panel 41, and the air pressure sensor 44 is connected to the third airbag 212 and the fourth airbag 222.

Specifically, the air pressure sensor 44 is used in conjunction with the heart rate sensor 43. For example, when the heart rate sensor 43 detects that the heart rate of the user is abnormal, if the air pressure sensor 44 detects that the air pressure inside the third airbag 212 or the fourth airbag 222 is abnormal but is in the range of normal air leakage, then the control panel 41 will activate the sensing switch 360, and the corresponding first bidirectional air pump 33 or the second bidirectional air pump 34 to continuously supply air to the first airbag 211 or the second airbag 221, and the first bidirectional air pump 33 or the second bidirectional air pump 34 will continuously pump gas into the third airbag 212 or the fourth airbag 222, so as to prolong the user's sinking time.

If the air pressure sensor 44 detects that the third airbag 212 or the fourth airbag 222 is leaking too rapidly, and it is difficult to maintain normal use by relying on the air provided by the air cylinder 36, the control panel 41 will directly close the first bidirectional air pumps 33 and the second bidirectional air pump 34, in order to ensure that the first airbag 211 and the second airbag 221 remain inflated and expandable by abandoning the use of the third airbag 212 and the fourth airbag 222, such that the swimsuit 1 can continue to provide buoyancy to prevent the user from sinking, thereby increasing the probability of rescue.

In summary, by means of the air pressure sensor 44 to monitor the air pressure conditions in the third airbag 212 and the fourth airbag 222 and feed back to the control panel 41, the sensing switch 360, the first bidirectional air pump 33, and the second bidirectional air pump 34 can be automatically activated and deactivated in case of an emergency, thereby realizing the automatic supply of air to the gas cylinders 36 under special circumstances, which further improves the safety coefficient.

It should be noted that the air pressure sensor 44 can determine the presence of air leaks and whether they are within normal air leakage range by detecting the air pressure values before or after within the chamber. As it is an existing product, its specific structure and working principle will not be elaborated in detail in the present disclosure.

Figure 9:
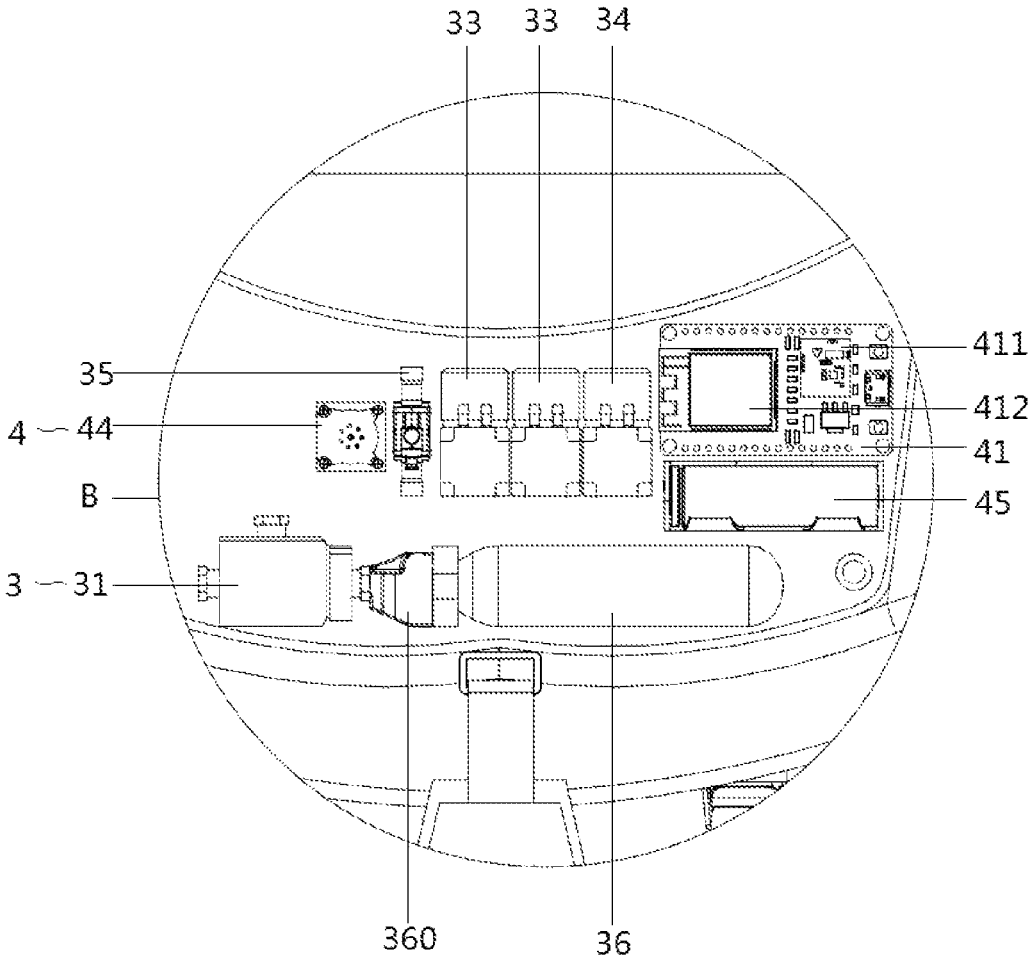
FIG. 9 illustrates an enlarged view at B in FIG. 8.
Figure 10:
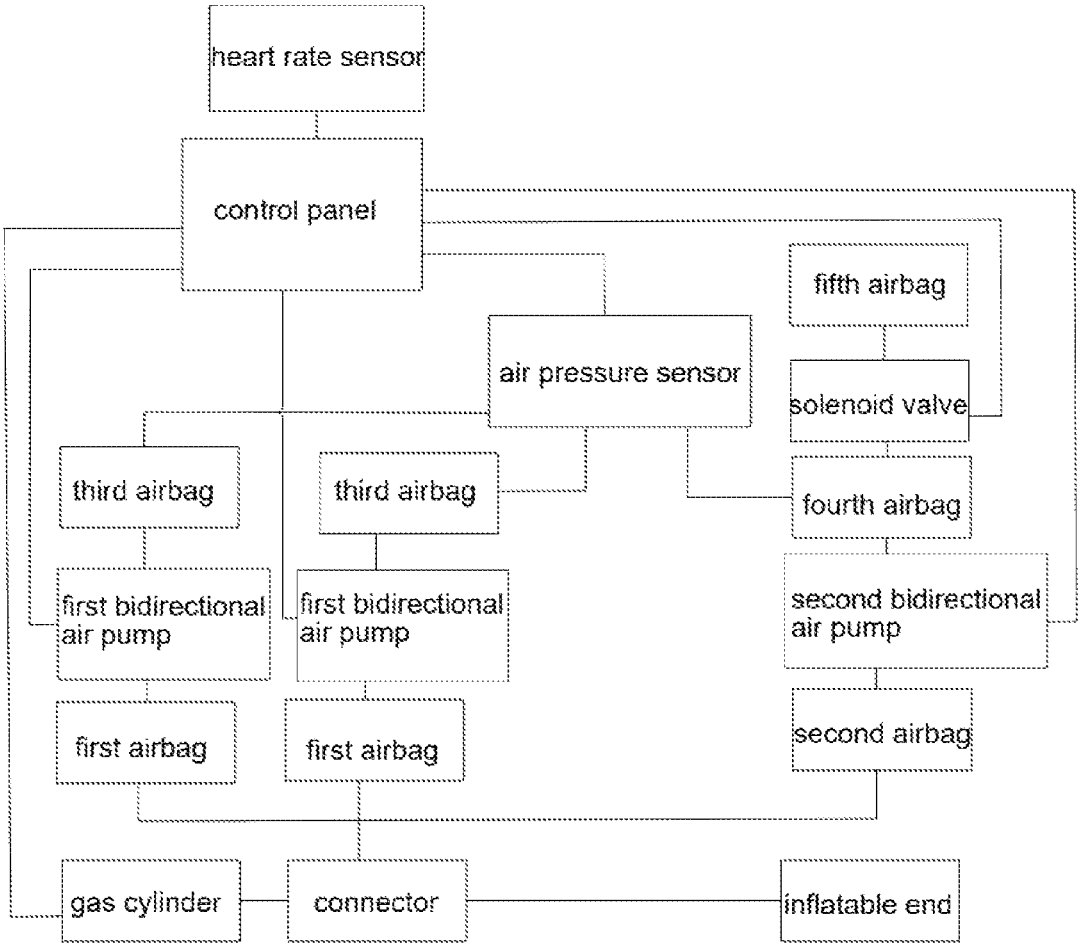
FIG. 10 illustrates a block diagram of the connection between the gas regulating structure and the main control mechanism.

Referring to FIG. 9, the main control mechanism 4 further comprises a battery 45 mounted in the waterproof shell 5 and electrically connected to the control panel 41 to supply power to the components.

Figure 6:
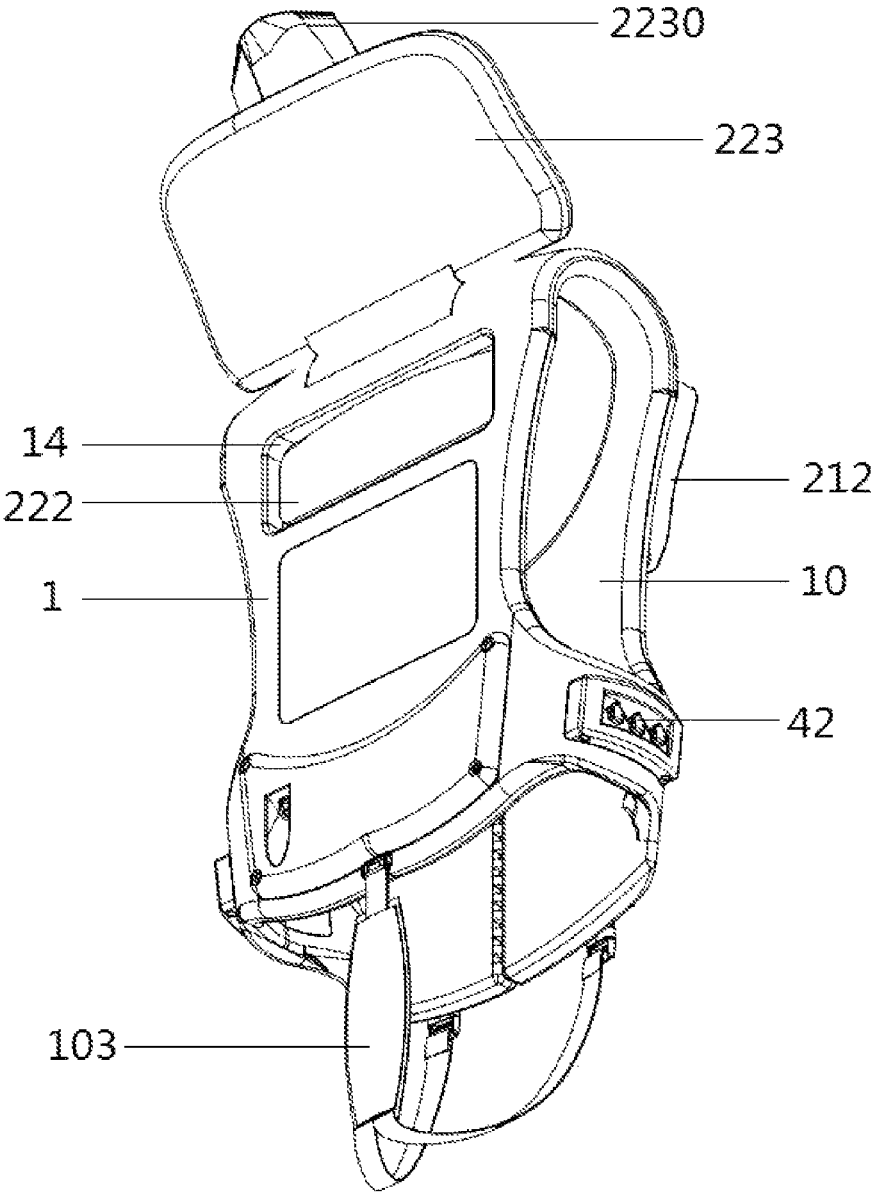
FIG. 6 illustrates a third schematic diagram of the overall structure according to the present disclosure III.
Figure 7:
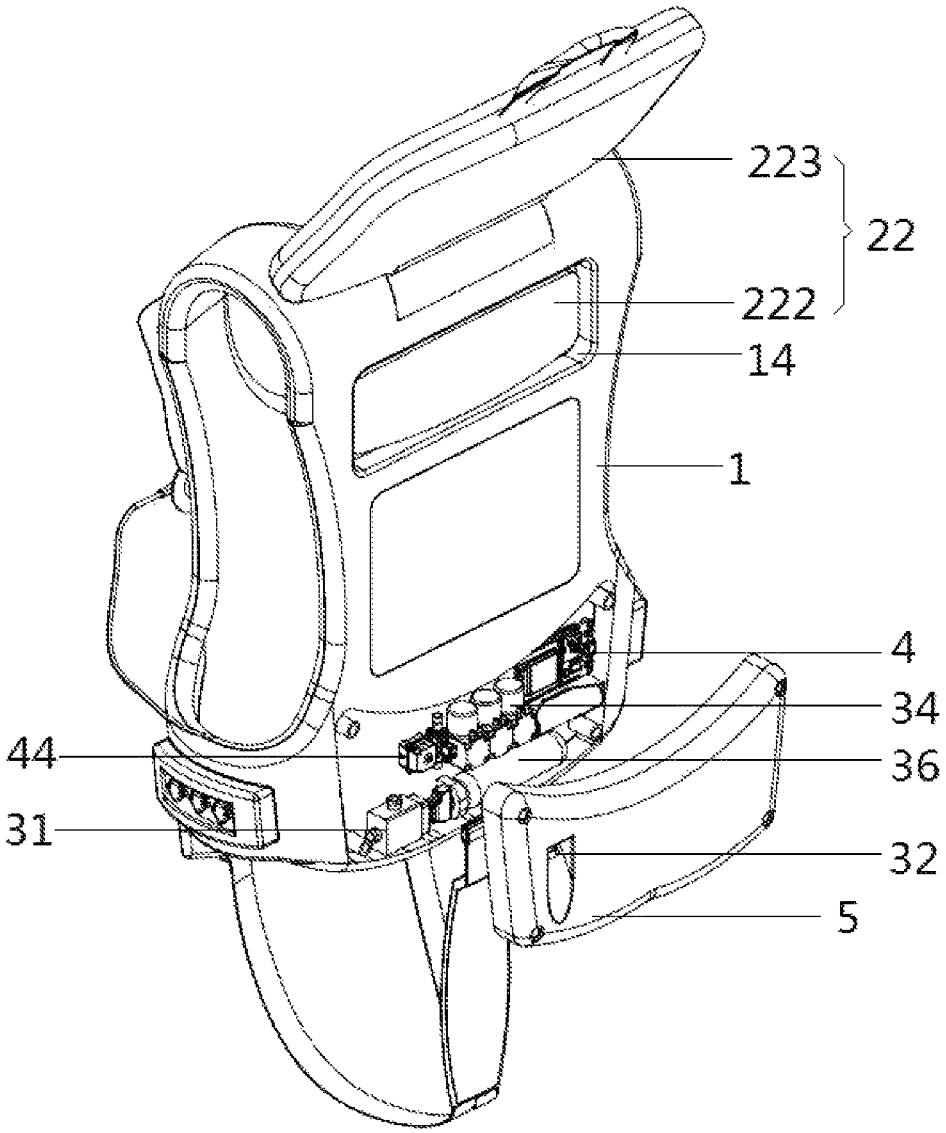
FIG. 7 illustrates a fourth schematic diagram of the overall structure according to the present disclosure.
Figure 8:
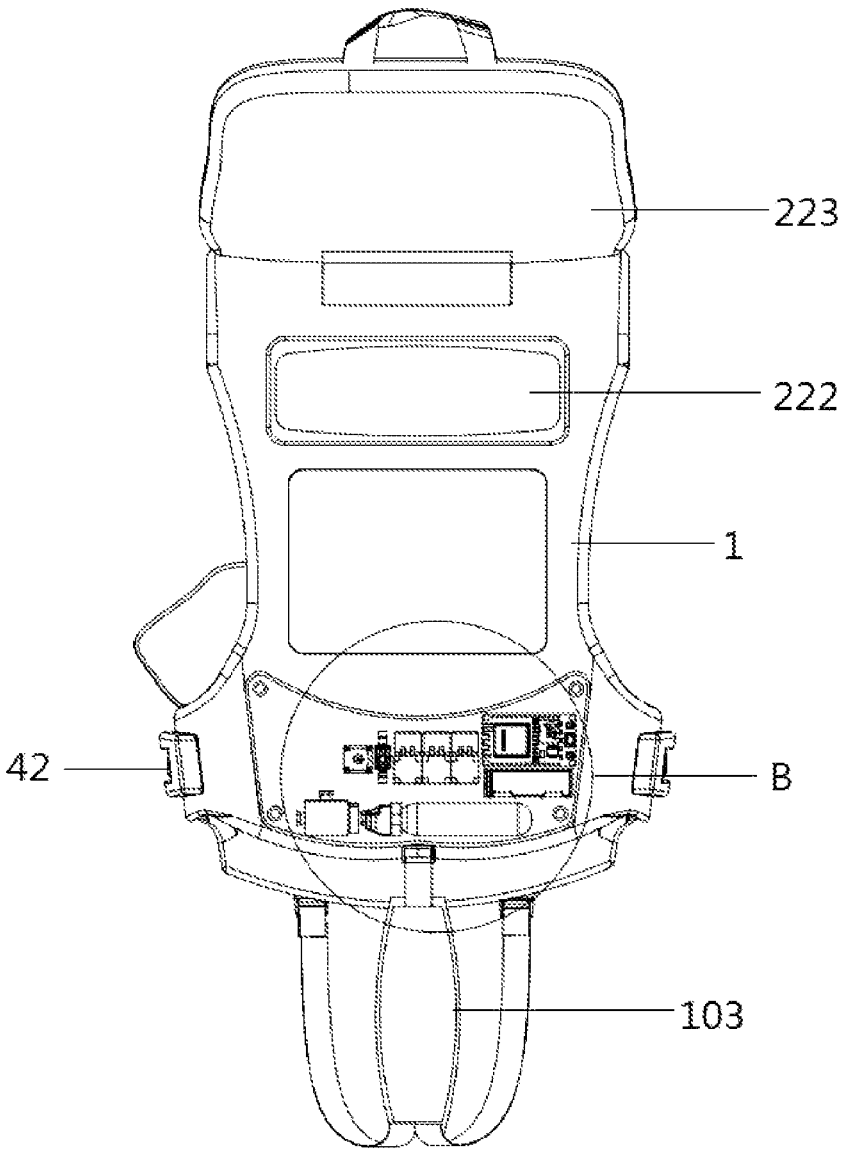
FIG. 8 illustrates a schematic diagram of a portion of the structure according to the present disclosure.

Referring to FIG. 6-FIG. 7, the present disclosure also includes a waterproof shell 5 mounted on the swimsuit 1. The gas regulating mechanism 3 and the main control mechanism 4 are both provided inside the waterproof shell 5. The design of the waterproof shell 5 can protect the compact elements of the gas regulating mechanism 3 and the main control mechanism 4 from being bumped and water ingress.

Among them, the battery 45 may be a removable disposable battery or a storage battery fixedly mounted, which is not limited in the present disclosure. Since the technology of supplying power to the electrical components through the battery 45 and the control panel 41, as well as the technology of charging the battery 45 are more common, the circuit structure thereof is not elaborated in detail in the present disclosure.

Referring to FIG. 9, in the present disclosure, the control panel 41 is provided with a wireless receiving module 412 that is signaling connected to a device such as a remote control or a cellular phone, so as to facilitate the acquisition by others of data such as the user's swimming postures and physical states, and thereby remotely control the operation of components such as various airbags, various air pumps, solenoid valve 35, and gas cylinder 36, so as to correct the swimming postures of the user and to ensure the safety of the user.

Referring to FIGS. 1-6, the front side of the swimsuit 1 is divided into two pieces of suit body that can be fixed or detached from each other, the first airbags 211 are provided with two and are respectively provided on the two pieces of the suit body 10, which is designed to facilitate the user to put on and take off the swimsuit 1, and to improve the convenience of use. The third airbags 212 are provided with two and are respectively provided on the top side of the two pieces of the suit body 10, corresponding to a position of the human neck. The first bidirectional air pumps 33 are provided with two, corresponding to the first airbags 211. The design not only helps maintain balance on both sides of the swimsuit 1 but also allows for more adjustable buoyancy positions, thereby enhancing usability.

Specifically, under normal circumstances, the gases inside the two first airbags 211 are consistent, and the gases inside the two third airbags 212 are also consistent, in order to maintain the balance of the two sides of the swimsuit 1. When the user needs to perform swimming skill training, the gas ratio among the two first airbags 211 and the two third airbags 212 can be controlled by the two first bidirectional air pumps 33, making the buoyancy strength of the four corners of the front of the swimsuit 1 change, thereby adapting to different swimming postures.

Referring to FIGS. 1-6, the swimsuit 1 is provided with a zipper 101 and buckle straps 102, and the zipper 101 and the buckle straps 102 are connected to two pieces of the suit body 10. Wherein the zipper 101 is pulled to fix or detach the two pieces of the suit body 10 from each other, which facilitates putting on and taking off the swimsuit. The lengths of the buckle straps 102 are adjusted to regulate the elasticity of the two pieces of the suit body 10, which in turn enables the swimsuit 1 to be able to fit closely to the waist of the user, reducing the possibility of slippage of the swimsuit 1.

Wherein, the zipper 101 may also be replaced by other structures such as buttons, ties, etc., and the buckled straps 102 may also be replaced by structures such as Velcro straps, belts, etc., which are not limited in the present disclosure.

Further, the buckle straps 102 are provided with two and arranged up and down, such that users with different body types can adjust the elasticity of the two buckle straps 102 according to the actual situation, such that the swimsuit 1 fits the body. Therefore, the design of the two buckle straps 102 can improve the applicability.

Referring to FIGS. 1-6, when in distress in water, the person in distress will instinctively raise his hands to call for help, and at this time, the swimsuit 1 will easily float upward and detach from the body. For this reason, in the present disclosure, the swimsuit 1 is provided with a crotch strap 103, the crotch strap 103 is provided at the bottom of the swimsuit 1 and connects the front of the swimsuit 1 to the back of the swimsuit 1, so as to match with the human crotch. The crotch strap 103, when in contact with the crotch, can provide tensile force for the swimsuit 1 to prevent the swimsuit 1 from moving upward and detaching from the body, further improving safety in use.

It is also noted that although embodiments of the present disclosure have been shown and described, it will be appreciated by one of ordinary skill in the art that a wide variety of changes, modifications, substitutions, and variations of these embodiments can be made without departing from the principles and spirit of the present disclosure.

What is claimed is:

1. A swimming assist garment capable of adjusting buoyancy positions, comprising a swimsuit and buoyancy foams filled in the swimsuit, wherein the swimming assist garment further comprises:

a buoyancy mechanism comprising a first buoyancy assembly and a second buoyancy assembly; the first buoyancy assembly comprises first airbags and third airbags mounted on a front side of the swimsuit, the second buoyancy assembly comprises a second airbag and a fourth airbag mounted on a back side of the swimsuit, and each third airbag and the fourth airbag are designed to match with a human neck when fully expanded; and a gas regulating mechanism mounted on the swimsuit and comprising a connector, an inflatable end, first bidirectional air pumps and a second bidirectional air pump; the inflatable end is connected to each first airbag and the second airbag via the connector, the first bidirectional air pumps are connected to each first airbag and each third airbag, and the second bidirectional air pump is connected to the second airbag and the fourth airbag.

2. The swimming assist garment capable of adjusting buoyancy positions according to claim 1, wherein the swimsuit is provided with a first sandwich and a first opening slot on front side, and the swimsuit is provided with a second sandwich and a second opening slot on back side; each first airbag and the second airbag are provided in the first sandwich and the second sandwich, respectively; each third airbag are mounted in the first opening slot and each third airbag is capable of expanding out of the first opening slot; the fourth airbag is provided in the second opening slot and the fourth airbag is capable of expanding out of the second opening slot.

3. The swimming assist garment capable of adjusting buoyancy positions according to claim 2, wherein each third airbag is fixedly connected to a bottom wall of the first opening slot in a middle of each third airbag, each third airbag is provided with magnetic blocks at two ends of each third airbag, bottom wall of the first opening slot is provided with a magnetic suction block that is mutually adsorbed with the magnetic blocks; and the magnetic blocks are detached from the magnetic suction block when each third airbag is fully expanded.

4. The swimming assist garment capable of adjusting buoyancy positions according to claim 1, wherein the second buoyancy assembly further comprises a fifth airbag mounted on a top of back side of the swimsuit, the gas regulating mechanism further comprises a solenoid valve mounted on the swimsuit and connected to the fourth airbag and the fifth airbag, the fifth airbag is matched with a human head when expanded.

5. The swimming assist garment capable of adjusting buoyancy positions according to claim 4, wherein the fifth airbag is mounted with a hanging strap.

6. The swimming assist garment capable of adjusting buoyancy positions according to claim 1, further comprising a main control mechanism; wherein the main control mechanism comprises a control panel and a plurality of control buttons mounted on the swimsuit; the control panel is mounted inside the swimsuit and electrically connected to the first bidirectional air pumps, the second bidirectional air pump and the plurality of control buttons.

7. The swimming assist garment capable of adjusting buoyancy positions according to claim 6, wherein the main control mechanism further comprises a heart rate sensor, the control panel is provided with a heart rate module; the heart rate sensor is mounted on the swimsuit and is connected to the heart rate module by signaling, and the heart rate sensor is configured for detecting a human heart rate.

8. The swimming assist garment capable of adjusting buoyancy positions according to claim 7, wherein the gas regulating mechanism further comprises a gas cylinder, a mouth of the gas cylinder is mounted with a sensing switch electrically connected to the control panel; the connector is a two-in-one-out gas valve, and two inlets of the valve is connected to an inflatable end and the gas cylinder respectively, and outlet of the gas valve is connected to the first airbags and the second airbag.

9. The swimming assist garment capable of adjusting buoyancy positions according to claim 8, wherein the main control mechanism further comprises an air pressure sensor mounted on the swimsuit and electrically connected to the control panel, and the air pressure sensor is connected to each third airbag and the fourth airbag.

10. The swimming assist garment capable of adjusting buoyancy positions according to claim 9, further comprising a waterproof shell mounted on the swimsuit, and the gas regulating mechanism and the main control mechanism are both provided inside the waterproof shell.

11. The swimming assist garment capable of adjusting buoyancy positions according to claim 1, wherein the front side of the swimsuit is divided into two pieces of suit body capable to be fixed or detached from each other, the first airbags are provided with two and each is provided on each piece of the suit body, and the third airbags are provided with two and each is provided on a top of each piece of the suit body in order to match with a position of human neck; and the first bidirectional air pumps are provided with two, corresponding to the first airbags.

12. The swimming assist garment capable of adjusting buoyancy positions according to claim 11, wherein the swimsuit is further provided with a zipper and buckle straps, and the zipper and the buckle straps are connected to two pieces of the suit body; by pulling the zipper, the two pieces of the suit body are fixed or disengaged from each other; and by adjusting lengths of the buckle straps, looseness or tightness of the two pieces of the suit body is adjusted.

13. The swimming assist garment capable of adjusting buoyancy positions according to claim 12, wherein the buckle straps are provided with two and provided up and down.

14. The swimming assist garment capable of adjusting buoyancy positions according to claim 11, wherein the swimsuit is further provided with a crotch strap provided at a bottom of the swimsuit and connected front side of the swimsuit and back side of the swimsuit to match with a human crotch.

* * * * *